US005555745A

United States Patent [19]

Agahi et al.

[11] Patent Number: 5,555,745

[45] Date of Patent: Sep. 17, 1996

[54] REFRIGERATION SYSTEM

[75] Inventors: Reza R. Agahi, Granada Hills; Behrooz Ershagi, Irvine, both of Calif.

[73] Assignee: Rotoflow Corporation, Gardena, Calif.

[21] Appl. No.: 417,842

[22] Filed: Apr. 5, 1995

[51] Int. Cl.[6] ..... F25D 9/00

[52] U.S. Cl. ..... 62/401; 62/513

[58] Field of Search ..... 62/401, 402, 86, 62/87, 93, 474, 513

[56] References Cited

U.S. PATENT DOCUMENTS 2,485,522 10/1949 Andersen ..... 62/402 X
3,868,827 3/1975 Linhardt et al. ..... 62/401 X
4,109,486 8/1978 Sieck ..... 62/402
4,507,939 4/1985 Wieland ..... 62/402
4,730,464 3/1988 Lotz ..... 62/401
5,373,707 12/1994 Ostersetzer et al. ..... 62/402 X

*Primary Examiner*—William E. Tapolcai
*Attorney, Agent, or Firm*—Lyon & Lyon

[57] ABSTRACT

A refrigeration system employing a motor driven compressor with an associated turboexpander coupled to the motor of the compressor. The compressor draws incoming air through a heat exchanger and a dehydrator. The compressor discharges compressed air through a high temperature heat exchanger and the other side of the heat exchanger on the inlet side of the compressor. The compressed air is then expanded through the turboexpander and used for cooling. The high temperature heat exchanger is employed for hot water generation.

10 Claims, 1 Drawing Sheet

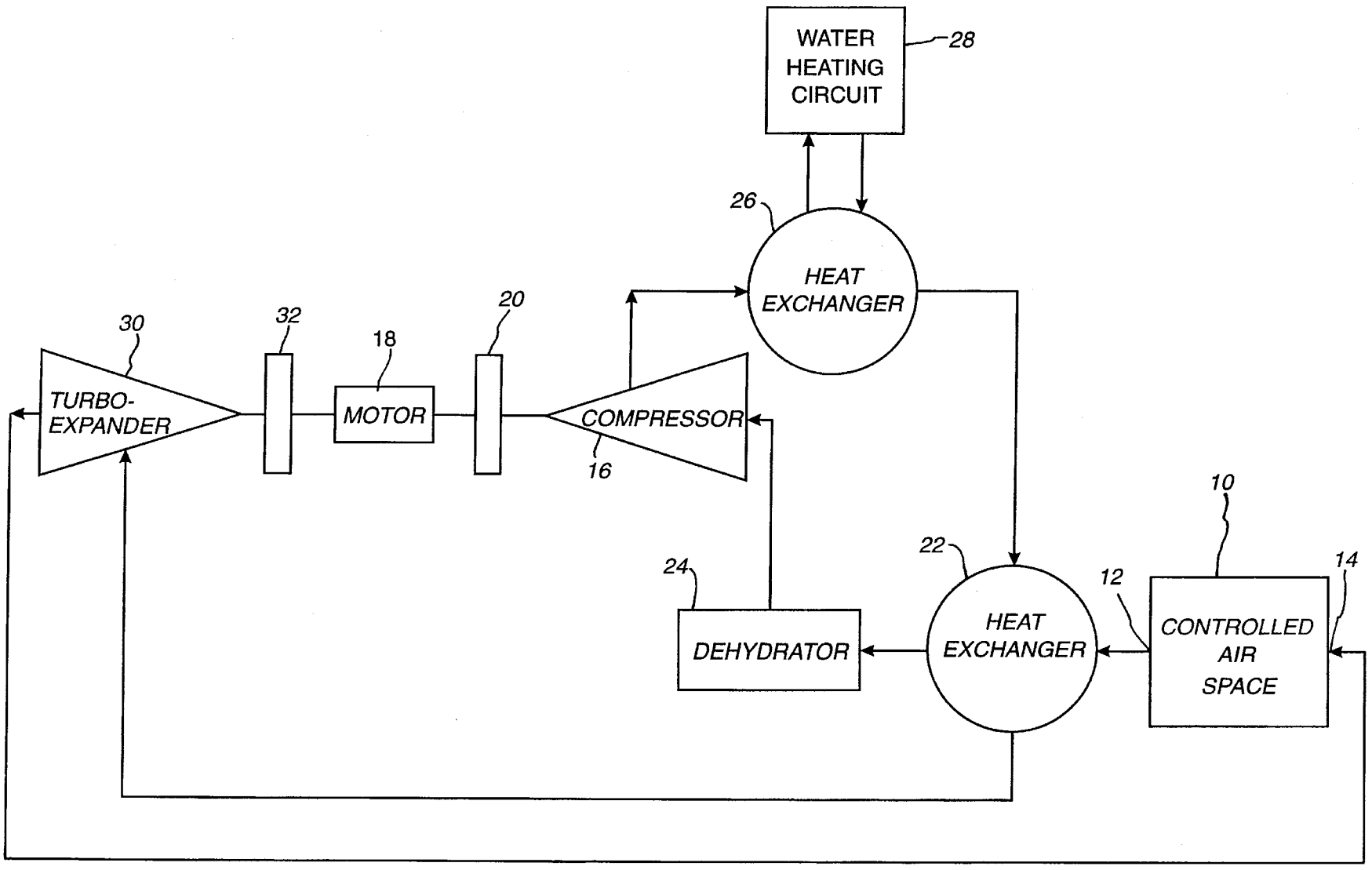
CONTROLLED AIR SPACE
10
14
12
HEAT EXCHANGER
22
DEHYDRATOR
24
WATER HEATING CIRCUIT
28
HEAT EXCHANGER
26
COMPRESSOR
16
20
MOTOR
18
32
TURBO-EXPANDER
30

REFRIGERATION SYSTEM

BACKGROUND OF THE INVENTION

The field of the present invention is refrigeration.

Commercial refrigeration has long employed absorption (Rankin cycle) or compression systems. Both of these systems require working process gas with specific thermodynamic characteristics. Chloro-fluorocarbon fluids, typically freon based, were used for many years. However, recent evidence suggests that these materials cause significant damage to the ozone layer around the Earth. New refrigerants are being developed in the hope of arresting if not reversing the damage.

Inefficient energy usage has also become of concern. Dwindling resources, increased population, energy costs, including the social costs of pollution, and the like have dictated more efficient energy uses. Refrigeration systems for air conditioning and other uses are understood to account for significant energy usage. Thus, efficient refrigeration systems are of significant importance.

Rotating machinery known to be used in refrigeration systems include compressors and turboexpanders. Rotary compressors are typically driven by motors through a shaft which may include gearing.

Turboexpanders typically include a radial inflow turbine rotor mounted within a housing having a radial inlet and an axial outlet. The turbine rotor is rotatably mounted within bearings through a shaft fixed to the rotor. Such turboexpanders may be used with a wide variety of different gas streams for such things as air separation, natural gas processing and transmission, recovery of pressure letdown energy from an expansion process, or thermal energy recovery from the waste heat of associated processes.

Three primary types of bearings that may be used to support the rotor shaft in turbo machinery are magnetic bearings, oil film bearings and gas bearings. Magnetic bearings provide superior performance over the other two bearings under many circumstances. Magnetic bearings have low drag losses, controlled stiffness and damping, and moderate load capacity. In addition, unlike oil film bearings, magnetic bearings do not require lubrication, thus eliminating oil, lines and associated components such as valves, pumps, filters, coolers and the like with the risk of process contamination.

SUMMARY OF THE INVENTION

The present invention is directed to refrigeration systems incorporating compressors and rotary expansion mechanisms commonly referred to as turboexpanders and using ambient fluid, typically air. Such turboexpanders provide for the efficient expansion of gases with corresponding reductions in temperature while at the same time recovering mechanical work. The systems operate on the refrigeration of an ambient space without the employment of a separate refrigerant. Interchanges of heat between lower and higher pressure states of the ambient fluids may also be considered to improve efficiency. Thermal energy may be directly taken for other uses in addition to the conversion of thermal energy to mechanical energy. Conditioning of the air from such a controlled air space prior to introduction into a compressor may further augment the practical nature of the system. Thus, an energy efficient system is available.

Accordingly, it is an object of the present invention to provide an improved refrigeration cycle. Other and further objects and advantages will appear hereinafter.

BRIEF DESCRIPTION OF THE DRAWING

The FIGURE is a schematic of a refrigeration system of the present invention.

DETAILED DESCRIPTION OF THE PREFERRED EMBODIMENT

The FIGURE schematically illustrates a system employing a refrigeration cycle with a turboexpander. A controlled air space 10 is the focus of the system with that air space 10 to be cooled. The space may be of any type, e.g., an air conditioned building, cold storage, freezer storage, sports arena and the like. Although air is contemplated as the ambient fluid of the space in the preferred embodiment, controlled atmospheres such as nitrogen may be equally applicable. Air is drawn from the controlled air space 10 at a return 12 and chilled air provided to the controlled air space 10 through the vent 14.

Air is drawn through the return 12 from the controlled air space 10 by a compressor 16. The compressor 16 is driven by a motor 18 providing a power source for the system. The compressor 16 is coupled by a shaft with the high or regular speed power source 18 either directly or through a gear 20. A magnetic bearing 20 is shown as a preferred rotary support.

The compressor 16 is coupled in fluid communication with the controlled air space 10 through a heat exchanger 22 and a dehydrator 24. The heat exchanger 22 and dehydrator 24 are of conventional design. The air is heated in passing through the first, tube-side of the heat exchanger and water is then removed by the dehydrator. In this way, the air is better conditioned for flow through the rotating equipment.

From the compressor 16, the compressed air flows through another heat exchanger 26. The first, tube-side flow from the compressor 16 through the heat exchanger 26 is then delivered to the second, shell-side of the heat exchanger 22 where further heat is transferred to the tube-side flow from the controlled air space. The second, shell-side of the heat exchanger 26 may use the discarded heat in a water heating circuit 28.

The compressed air which has been treated before compression and then cooled through the heat exchangers 22 and 26 is expanded through a turboexpander 30. The turboexpander 30 may be coupled with the motor 18 through a gear. A magnetic bearing 32 may be used to support the shaft. Thus, the air is efficiently decompressed and cooled with mechanical work derived from this operation. Turboexpanders contemplated for the present system are conventional. Once expanded, the cold air is returned to the vent 14 for introduction into the controlled air space 10.

The magnetic bearings 20 and 32 may be employed for the high speed rotating equipment to further assist in establishing efficient operation. Pressure balancing systems are also available to reduce loads on the equipment.

Thus, an improved refrigeration system is disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A refrigeration system to cool a controlled space of ambient fluid, comprising a compressor coupled in fluid communication with the controlled space;

a first heat exchanger having a first side being coupled in fluid communication between the controlled space and the compressor and a second side, the first side of the first heat exchanger including cooling fluid which is flow of ambient fluid from the controlled space to the compressor;

a turboexpander having an inlet and an outlet, the inlet being coupled in fluid communication with the compressor and the outlet being coupled in fluid communication with the controlled space, the second side of the first heat exchanger being coupled in fluid communication between the compressor and the turboexpander;

a dehydrator in fluid communication between the first side of the first heat exchanger and the compressor, the controlled space being an air space and the fluid communication being of air.

2. The refrigeration system of claim 1, the compressor including a motor, the turboexpander being mechanically coupled with the motor.

3. The refrigeration system of claim 2, at least one of the compressor and the turboexpander including magnetic bearings.

4. The refrigeration system of claim 1 further comprising a second heat exchanger having a first side and a second side, the first side of the second heat exchanger being in fluid communication and between the compressor and the second side of the first heat exchanger.

5. The refrigeration system of claim 4 further comprising a water heating circuit including the second side of the second heat exchanger.

6. The refrigeration system of claim 4, the compressor including a motor, the turboexpander being mechanically coupled with the motor.

7. The refrigeration system of claim 1, the controlled space being an air space and the fluid communication being of air.

8. A refrigeration system to cool a controlled space, comprising a compressor coupled in fluid communication with the controlled space to compress air from the controlled space and including a motor;

a first heat exchanger having a first side and a second side, the first side of the first heat exchanger being coupled in fluid communication between the controlled air space and the compressor;

a second heat exchanger having a first side and a second side, the second side of the second heat exchanger including cooling fluid;

a turboexpander having an inlet and an outlet and being mechanically coupled with the motor, the inlet being coupled in fluid communication with the compressor and the outlet being coupled in fluid communication with the controlled air space, the second side of the first heat exchanger and the first side of said second heat exchanger being coupled in fluid communication between the compressor and the turboexpander with the second heat exchanger being between the compressor and the first heat exchanger;

a dehydrator in fluid communication between the first side of the first heat exchanger and the compressor.

9. The refrigeration system of claim 8 further comprising a water heating circuit including the second side of the second heat exchanger.

10. The refrigeration system of claim 8, at least one of the compressor and the turboexpander including magnetic bearings.

* * * * *